US005469647A

United States Patent [19]

Profio

[11] Patent Number: 5,469,647

[45] Date of Patent: Nov. 28, 1995

[54] POWER SHOVEL

[75] Inventor: Richard L. Profio, Wauwatosa, Wis.

[73] Assignee: Harnischfeger Corporation, Brookfield, Wis.

[21] Appl. No.: 154,187

[22] Filed: Nov. 18, 1993

[51] Int. Cl.[6] ..... E02F 3/30

[52] U.S. Cl. ..... 37/398; 37/444; 414/718

[58] Field of Search ..... 37/397, 398, 442, 37/443, 444, 445; 414/718, 719, 720

[56] References Cited

U.S. PATENT DOCUMENTS

| | | | |
|---|---|---|---|
| 1,478,622 | 12/1923 | Toussaint et al. . | |
| 1,550,938 | 8/1925 | Walsh | 37/445 X |
| 1,765,893 | 6/1930 | Wayner et al. | 37/443 |
| 1,905,191 | 4/1933 | Snow, Jr. | 37/443 |
| 2,152,907 | 4/1939 | Miller | 37/443 |
| 2,610,753 | 9/1952 | Morin | 37/398 X |
| 2,719,641 | 10/1955 | Pilch | 37/398 X |
| 3,278,057 | 10/1966 | Drollinger et al. | 37/445 X |
| 3,508,674 | 4/1970 | Schneider | 214/145 |
| 3,580,405 | 5/1971 | Siegel et al. | 214/135 |
| 4,939,855 | 7/1990 | McCreary, Jr. | 37/444 |

OTHER PUBLICATIONS

Subsection D Dipper Components (Harnischfeger Corporation).

*Primary Examiner*—Dennis L. Taylor
*Assistant Examiner*—Robert Pezzuto
*Attorney, Agent, or Firm*—Michael, Best & Friedrich

[57] ABSTRACT

A power shovel comprising a frame, a winch mounted on the frame, a boom having a lower end mounted on the frame and having an upper end, a sheave pivotally mounted on the boom adjacent the upper end of the boom, a dipper handle mounted on the boom for pivotal movement relative thereto and relative to a dumping position, a dipper mounted on the forward end of the dipper handle and having closed and open conditions for respectively containing and dumping a load and further including a latch mechanism for releasably securing the dipper in the closed condition, and a hoist rope extending over the sheave and having one end connected to the winch and an opposite end connected to the dipper such that when the dipper handle is in the dumping position the hoist rope exerts on the dipper a force biasing the dipper to the open condition when the latch mechanism is released.

33 Claims, 3 Drawing Sheets

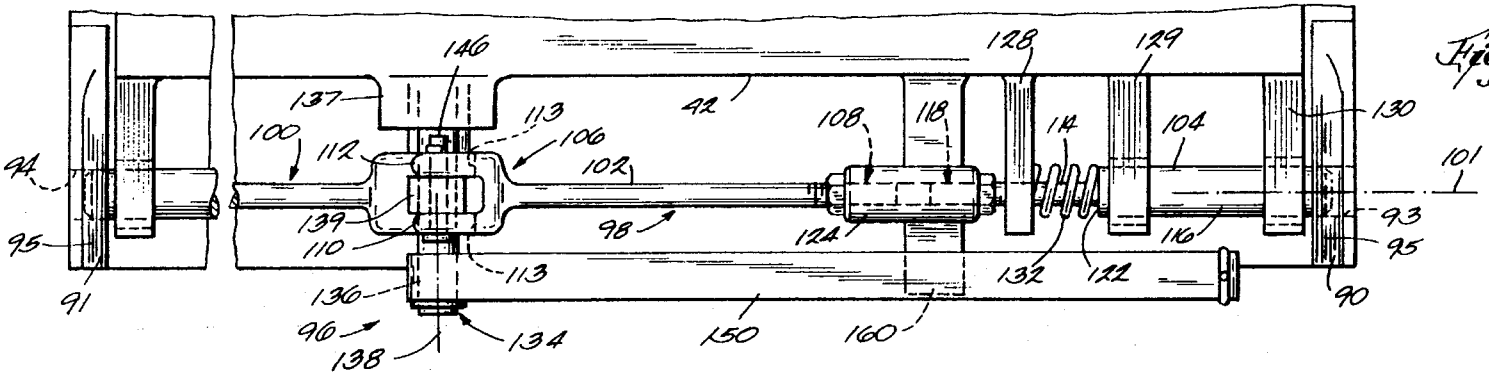
Fig. 9
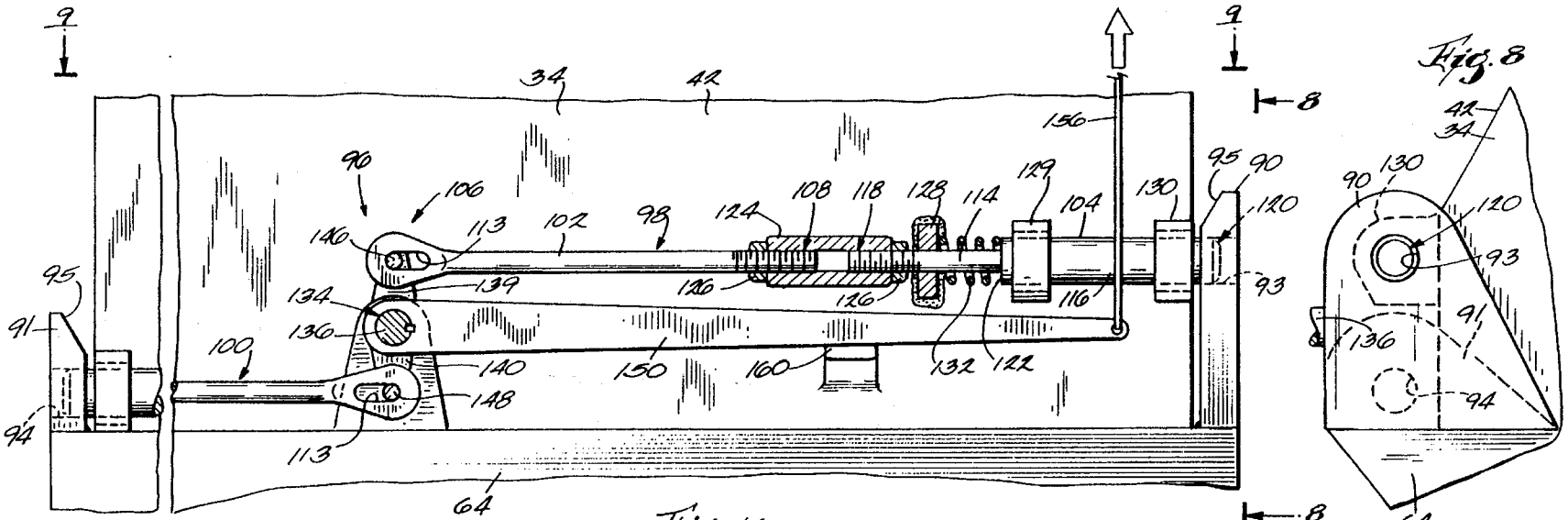
Fig. 7
Fig. 8

POWER SHOVEL

FIELD OF THE INVENTION

The invention relates to power shovels, and more particularly to power shovels having a boom from which a dipper handle and dipper are supported.

REFERENCE TO THE PRIOR ART

Power shovels for use in digging operations are illustrated generally in U.S. Pat. Nos. 3,508,674 and 3,580,405. Power shovels typically include a revolvable upper frame mounted on ground engaging means such as crawler tracks. A fixed boom extends upwardly and outwardly from the frame. A dipper handle is mounted on the boom for movement about a rack pinion or crowd drive mechanism for pivotal and translational movement relative to the boom. A dipper is fixed to the end of the dipper handle. The outer end of the boom has thereon a sheave, and a hoist cable extends over the sheave from a winch drum on the frame and is fastened to the dipper to support and partially control movement of the dipper.

The dipper typically includes a main body and a door. The main body is supported on pins in fixed relation to the dipper handle. The main body includes front, rear and opposite side walls that all extend generally vertically when the dipper handle extends horizontally. The main body has an open top and an open bottom. When the dipper is in a digging position, the front wall generally travels along and contacts the material being excavated. A plurality of digging teeth extend from the front wall. The bottom of the main body is closed by the door during digging. The door is pivotally mounted on either the dipper handle or the rear wall of the main body and the door is selectively latched to the front wall of the main body to close and open the bottom of the main body. The latch mechanism includes a single latch bar that extends into a keeper or aperture in the main body to hold the door closed. In a pre-dumping position, the dipper handle extends generally horizontally, the front wall of the main body extends generally vertically and the door is closed and generally horizontal. For dumping, a latch or trip chain is actuated to unlatch the door by withdrawing the latch bar from the keeper, and the door pivots open downwardly by gravity, thereby dumping the load of excavated material.

U.S. Pat. No. 1,478,622 discloses a dredging bucket which is mounted on a handle S and connected to a boom by ropes O and H. The bucket includes a main body L and a rear wall R. The rear wall is fixed on the end of the handle perpendicular to the longitudinal axis of the handle. The main body is mounted on the rear wall for pivotal movement relative thereto about a pivot point B. One rope H is connected to the main body at a point A inward of the pivot point B, and the second rope O is connected to the main body at a point C outward of the pivot point B. The bucket does not include a separate latch mechanism, but rather is opened and closed by varying the loads on the two ropes to pivot the main body about the pivot point. Loading the rope H more than the rope O causes the main body to shut against the rear wall. Loading the rope O more than the rope H causes the main body to pivot away from the rear wall, thereby opening the bucket for dumping a load.

SUMMARY OF THE INVENTION

The invention provides a power shovel including a dipper handle movable relative to dumping and closing positions, and a hoist rope connected to the dipper such that, when the dipper handle is in the dumping position, the hoist rope exerts on the dipper a force biasing the dipper to the open condition, and such that, when the dipper handle moves to the closing position with the dipper in the open condition, the hoist rope exerts on the dipper a force biasing the dipper to the closed condition.

The invention also provides a power shovel including a dipper having back and front walls, opposed side walls which extend between the back and front walls, and a bottom wall extending, at least in part, downwardly and rearwardly from the lower end of the front wall when the dipper handle is in the horizontal position, thereby providing clearance for crawler tracks when the dipper is moved toward the crawler tracks.

The invention also provides a power shovel including a dipper having first and second sections each having opposed first and second sides, and a latch mechanism for releasably securing the first side of the first section to the first side of the second section and the second side of the first section to the second side of the second section.

More particularly, the invention provides a power shovel having a revolvable upper frame mounted on ground engaging means such as a set of crawler tracks. A boom extends upwardly and outwardly from the frame. A dipper handle is mounted on the boom for pivotal and translational movement relative thereto. The dipper handle has a forward end to which a dipper is mounted. The dipper handle is movable relative to a horizontal position, a dumping position, and a closing position. A hoist rope is connected to the dipper for raising and lowering the dipper.

The dipper includes back and front sections. The back section includes a back wall which is mounted on the forward end of the dipper handle. The back section also includes opposed left and right side walls extending forwardly from the back wall. The side walls include respective forward edges and upper and lower ends. The front section includes opposed left and right side walls which are pivotally connected to the respective back section side walls adjacent the forward edges and upper ends of the back section side walls for pivotal movement of the front section relative to the back section about a generally horizontal pivot axis and between open and closed positions. The front section side walls also include respective extensions extending rearwardly and upwardly relative to the pivot axis when the dipper handle is in the horizontal position, and the hoist rope is pivotally connected to the extensions by a bail. The front section side walls also include, adjacent the lower ends thereof, respective projections which extend rearwardly when the dipper handle is in the horizontal position. Each side wall projection has therein a respective aperture for engagement with a latch mechanism described below. The front section also includes a front wall which extends between the front section side walls and generally vertically when the dipper handle is in the horizontal position. The front wall has a lower end, and a bottom wall extends downwardly and rearwardly from the lower end when the dipper handle is in the horizontal position, thereby providing clearance for the crawler tracks when the dipper is moved toward the crawler tracks. A plurality of digging teeth extend from the upper end of the front wall of the front section.

The latch mechanism releasably secures the front section in the closed position relative to the back section. The latch mechanism includes a pair of oppositely extending latch rods supported on the back section for sliding movement between an extended position and a retracted position. In the extended position, the outer end portions of the latch rods are received in the front section side wall apertures. In the retracted position, the outer end portions are removed from and clear of the apertures. The latch rods are biased toward the extended position. Each latch rod is pivotally and slidably connected to a crank. When the crank is pivoted by pivotal movement of a latch lever, the latch rods move from the extended positions to the retracted positions, thereby allowing the dipper to open. When the dipper handle is in the dumping position, the hoist rope biases the dipper front section to its open position when the latch mechanism is released. When the dipper handle is thereafter moved to its closing position, the hoist rope biases the dipper front section back to its closed position and the latch mechanism is re-engaged.

The power shovel has a dipper which opens and closes rapidly because of forces exerted by the hoist rope on the front section of the dipper. This permits excavation to proceed at a higher rate than with a power shovel having a door opened and/or closed solely by gravity. Forces exerted by the hoist rope also prevent the front section of the dipper from swinging relative to the back section when dumping a load. The front section of the dipper is detachable from the back section for repair of portions of the front section, such as the front wall or the digging teeth, which frequently contact the ground and are worn thereby. The front section is also relatively small compared to the main body of conventional dippers, so that relatively little material must be replaced to repair worn portions of the dipper.

Other features and advantages of the invention will become apparent to those skilled in the art upon review of the following detailed description, claims and drawings.

BRIEF DESCRIPTION OF THE DRAWINGS

FIG. 7 is an enlarged, partial view taken generally along line 7—7 in FIG. 4, showing the latch mechanism engaging apertures in the front section to retain the front section in the closed position.

FIG. 8 is an end view taken generally along line 8—8 in FIG. 7, showing the latch rods extending into the front section apertures.

FIG. 9 is a view taken generally along line 9—9 in FIG. 7.

Figure 1:
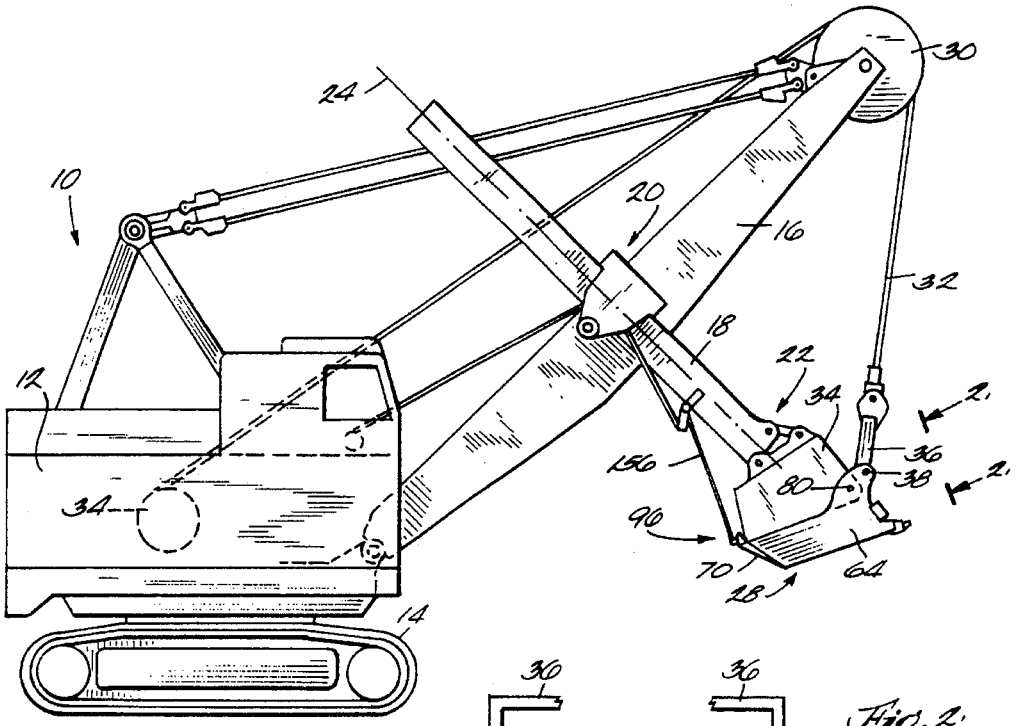
FIG. 1 is a side elevational view of a power shovel embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 4:
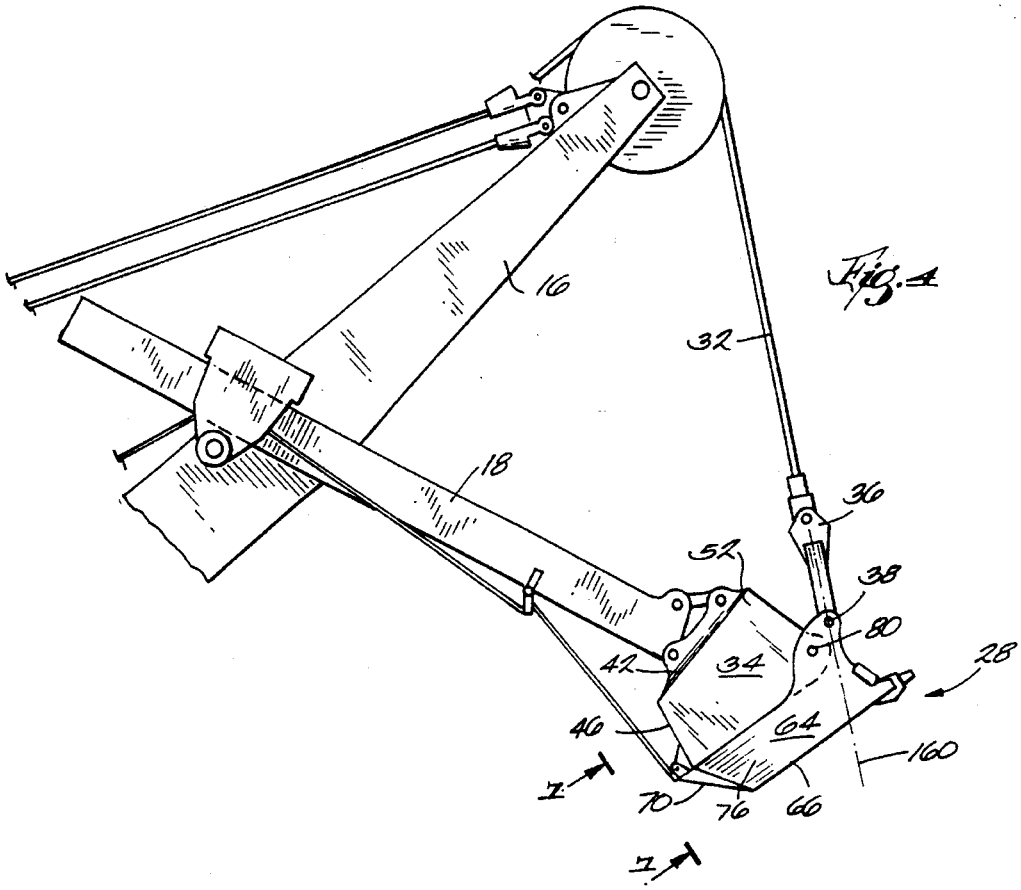
FIG. 4 is an enlarged side elevational view of the dipper handle and dipper shown generally in FIG. 1, showing the dipper handle in the dumping position and the dipper in the closed condition with the front section in the corresponding closed position.

Illustrated in the drawings is a power shovel 10 embodying the invention. The power shovel 10 includes (see FIG. 1) a revolvable upper frame 12 mounted on ground engaging means, which in the illustrated embodiment of the invention is a set of crawler tracks 14. A fixed boom 16 extends upwardly and outwardly from the frame 12. A dipper handle 18 is mounted on the boom 16 by a rack and pinion or crowd drive mechanism 20 for pivotal and translational movement relative to the boom 16. The dipper handle 18 has a forward end 22 and a longitudinal axis 24 which defines (see FIG. 2) a generally vertical plane 26. The dipper handle 18 is movable relative to a horizontal position shown generally in FIG. 6, a dumping position shown generally in FIG. 4, and a closing position shown generally in FIG. 6. A dipper 28 is mounted on the forward end 22 of the dipper handle 18. The outer end of the boom 16 has thereon a sheave 30, and a hoist cable or rope 32 extends over the sheave 30 from a winch drum 34 mounted on the frame 12 and is connected to a bail 36 connected to the dipper 28 for pivotal involvement relative thereto about a pivot axis 38 perpendicular to the plane 26. The dipper 28 is supported only by the dipper handle 18 and the hoist rope 32. As used herein, "hoist rope" includes, in addition to a single hoist rope, a plurality of hoist ropes connected to the dipper 28 along a single line or pivot axis perpendicular to the plane 26.

Figure 2:
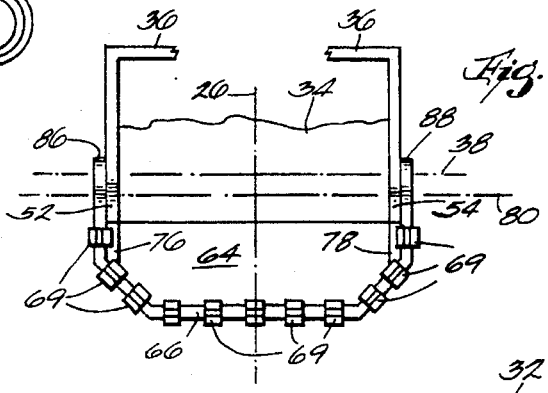
FIG. 2 is an end view taken generally along line 2—2 in FIG. 1, showing the bail and a portion of the dipper.

The dipper 28 includes (see FIG. 6) a first or back section 34 mounted on the forward end 22 of the dipper handle 18. The back section 34 includes a back wall 42 mounted on the forward end 22 of the dipper handle 18. The back wall 42 has a lower end 44 and extends generally vertically when the dipper handle 18 is in the horizontal position shown in FIGS. 4–6. The back section 34 also includes a bottom wall 46 which extends forwardly and downwardly from the lower end 44 of the back wall 42 when the dipper handle 18 is in the horizontal position. As shown in FIG. 2, the back section 34 further includes opposed first and second or left and right side walls 52 and 54. The side walls 52 and 54 extend forwardly from the back wall 42 and upwardly from the bottom wall 46 when the dipper handle 18 is in the horizontal position. The side walls 52 and 54 include (see FIG. 6) respective forward edges 56 spaced from the back wall 42 and include respective upper ends 60.

The dipper 28 also includes a second or front section 64 pivotally connected to the back section 34. As shown generally in FIG. 6, the front section 64 includes a front wall 66 which has upper and lower ends 67 and 68 and which extends generally vertically when the dipper handle 18 is in the horizontal position. Digging teeth 69 extend from the upper end 67 of the front wall 66. The front section 64 also includes a bottom wall 70. The bottom wall 70 extends downwardly and rearwardly from the lower end 68 of the front wall 66 when the dipper handle 18 is in the horizontal position. The bottom wall 70 thus provides clearance for the crawler tracks 14 when the dipper 28 is moved toward the crawler tracks 14. The front section 64 also includes (see FIG. 2) opposed first and second or left and right side walls 76 and 78. The side walls 76 and 78 extend rearwardly from the front wall 66 and upwardly from the bottom wall 70 when the dipper handle 18 is in the horizontal position. The front section side walls 76 and 78 are respectively pivotally connected to the back section side walls 52 and 54 for pivotal movement of the front section 64 relative to the back section 34 about a generally horizontal axis 80 located adjacent the forward edges 56 and upper ends 60 of the back section side walls 52 and 54. The front section side walls 76 and 78 include respective extensions 86 and 88 extending rearwardly and upwardly relative to the pivot axis 80 when the dipper handle 18 is in the horizontal position, and the bail 36 is pivotally connected to the extensions 86 and 88 as shown in FIG. 2. The front section side walls 76 and 78 also include (see FIGS. 7–9), adjacent the bottom wall 70 of the front section 64, respective projections 90 and 91 which extend rearwardly when the dipper handle 18 is in the horizontal position. The first side wall projection 90 has therein a first aperture 93, and the second side wall projection 91 has therein a second aperture 94, the function of which will be described below. The side wall projections 90 and 91 each include (see FIGS. 7 and 9) a beveled edge 95, the function of which is also described below.

Figure 6:
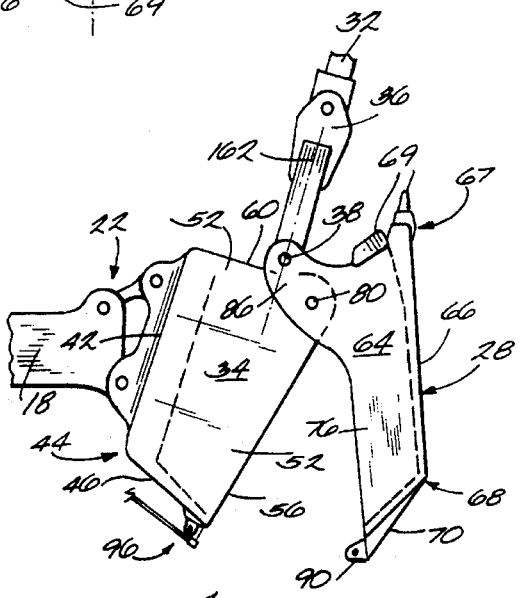
FIG. 6 is a side elevational view similar to FIG. 3, showing the dipper in the open condition and the dipper handle in the closing position so that the hoist rope applies a force biasing the front section of the dipper toward the closed position.
Figure 5:
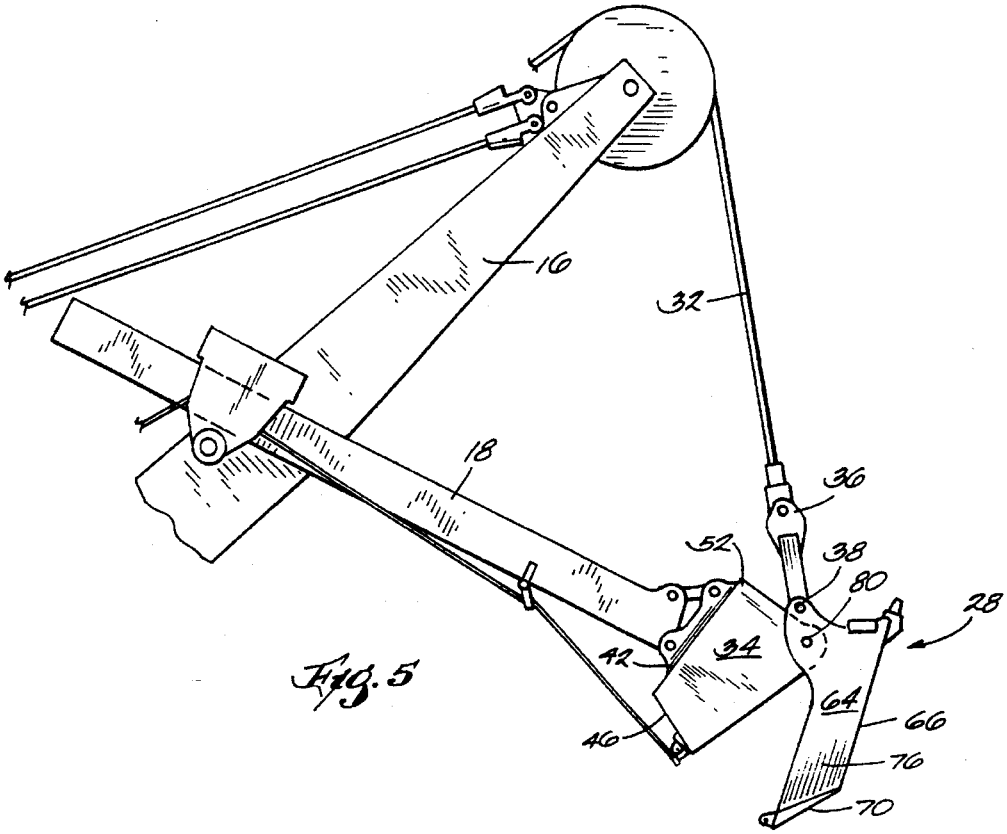
FIG. 5 is a side elevational view similar to FIG. 4, showing the dipper handle in the dumping position and the dipper in the open condition with the front section in the corresponding open position.

The dipper 28 has open and closed conditions for respectively containing and dumping a load. The open condition is shown in FIGS. 5 and 6, and the closed condition is shown in FIGS. 1–4. The front section 64 is pivotal relative to the back section 34 between open and closed positions respectively corresponding to the open and closed conditions of the dipper 28.

The dipper 28 includes (see FIGS. 7–9) a latch mechanism 96 for releasably securing the front section 64 in the closed position. The latch mechanism 96 includes a pair of oppositely extending latch rods 98 and 100 mounted on the back section bottom wall 46. The latch rods 98 and 100 are identical and only latch rod 98 will be described in detail. The latch rod 98 has a longitudinal axis 101 and includes first and second or left and right portions 102 and 104. The left portion 102 includes a clevis portion 106 and a threaded portion 108 opposite the clevis portion 106. The clevis portion 106 includes (see FIG. 9) a pair of spaced arms 110 and 112 each having therein an elongated slot 113. The right portion 104 includes a reduced diameter inner portion 114 and an enlarged diameter outer portion 116. The reduced diameter portion 114 includes a threaded portion 118. The outer portion 116 includes a tapered or beveled end 120, the function of which is described below. A shoulder 122 is formed at the transition between the reduced diameter portion 114 and the enlarged diameter portion 116. The left and right portions 102 and 104 are joined at the respective threaded portions 108 and 118 by a threaded turnbuckle 124. A pair of nuts 126 are respectively threaded on the threaded portions 108 and 118 for preventing the turnbuckle 124 from moving during operation of the dipper 28.

The latch rod 98 is slidably supported by bosses 128, 129 and 130 which extend from the bottom wall 46 and which have therein respective apertures for receiving the latch rod 98. The latch rod 98 is slidably movable from an extended position (shown in FIGS. 7–9) in which the outer portion 116 of the latch rod 98 is received in the aperture 93 ill the front section projection 90, and a retracted position (not shown) in which the outer portion 116 of the latch rod 98 is removed from and clear of the aperture 93. A compression spring 132 around the latch rod 98 extends between the boss 128 and the shoulder 122 to bias the latch rod 98 toward the extended position.

A crank 134 is pivotally and slidably connected to the latch rods 98 and 100. The crank 134 includes a shaft 136 pivotally mounted on a bearing block 137 (see FIG. 9) for pivotal movement of the crank 134 about a pivot axis 138. Arms 139 and 140 extend outwardly from the shaft 136. Pins 146 and 148 respectively extend through the arms 139 and 140 and the slots 113 in the latch rods 98 and 100 to provide a lost-motion connection between the crank 134 and the latch rods 98 and 100. When the crank 134 is pivoted counter-clockwise as seen in FIG. 7, the latch rods 98 and 100 move from the extended positions to the retracted positions.

A latch lever 150 has one end fixedly mounted to the crank shaft 136 for pivotal movement therewith about the crank arm pivot axis 138. The opposite end of the latch lever 150 is connected to a conventional trip chain 156 (see FIG. 7) which is operable to cause the latch lever 150 and crank 134 to pivot counter-clockwise about the pivot axis 138 and cause the latch rods 98 and 100 to move from the extended positions to the retracted positions, thereby disengaging the latch mechanism 96. A stop 160 extends from the bottom wall 46 and prevents movement of the lever 150 beyond the position shown in FIG. 7.

Figure 3:
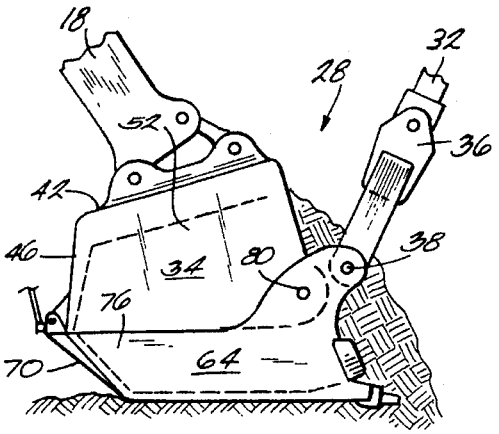
FIG. 3 is an enlarged side elevational view of the dipper shown generally in FIG. 1, showing the dipper in the closed condition with the front section in the corresponding closed position and contacting the ground for excavating a load of material.

In operation, with the latch mechanism 96 engaged to retain the front section 64 in the closed position, the dipper handle 18 is pivoted downwardly for the dipper 28 to contact the ground. The dipper handle 18 is extended and pivoted as necessary for the dipper 28 to move and excavate material as shown in FIG. 3. The dipper handle 18 is then moved to the dumping position shown in FIG. 4, so that the hoist rope 32 extends along a line 160 in front of the pivot axis 80 and therefore applies to the front section 64 a force biasing the front section 64 toward the open position (counter-clockwise in FIG. 4). The latch mechanism 96 is then disengaged, and the front section 64 pivots open relative to the back section 34, as shown in FIG. 6, thereby dumping the load of material. Because the hoist rope 32 continues to exert a force on the front section 64, the front section 64 is substantially prevented from swinging relative to the back section 34.

To close the dipper, the dipper handle 18 is retracted to the closing position so that the hoist rope 32 extends along a line 162 rearward of the pivot axis 80 as shown in FIG. 6. In this position, the hoist rope 32 applies a force biasing and moving the front section 64 toward the closed position (clockwise in FIG. 6). As the front section 64 moves toward the closed position, the beveled edges 95 one the front section projections 90 and 91 engage the tapered end portions 120 of the latch rods 98 and 100 as shown in FIG. 9, such that the latch rods 98 and 100 move from the extended positions to the retracted positions. The pins 146 and 148 are slidable in the clevis arm slots 113 such that the latch rods 98 and 100 can move from the extended positions to the retracted positions without causing the crank 134 and the lever 150 to pivot. The front section 64 continues moving toward the closed position until the latch rods 98 and 100 return to the extended positions and extend into the respective apertures 93 and 94 to retain the front section 64 in the closed position.

I claim:

1. A power shovel comprising a frame, a winch mounted on said frame, a boom having a lower end mounted on said frame and having an upper end, a sheave pivotally mounted on said boom adjacent said upper end of said boom, a dipper handle mounted on said boom for pivotal movement relative thereto, said dipper handle being movable relative to a dumping position, a dipper mounted on said dipper handle, said dipper including one section mounted on said dipper handle and an other section movable relative to said one section between closed and open conditions for respectively containing and dumping a load, and said dipper further including a latch mechanism for releasably securing said other dipper section in said closed condition, and a hoist rope extending over said sheave, said rope having one end connected to said winch and an opposite end connected to said other dipper section such that, when said dipper handle is in said dumping position, said hoist rope exerts on said other dipper section a force moving said other dipper section relative to said one dipper section so as to change said other dipper section to said open condition when said latch mechanism is released, and such that said hoist rope moves said dipper handle relative to said boom in response to operation of said winch.

2. A power shovel as set forth in claim 1 wherein said dipper handle is also movable to a closing position, and wherein said hoist rope is also connected to said dipper such that, when said dipper handle moves to said closing position with said Other dipper section in said open condition, said hoist rope exerts on said dipper a force moving said other dipper section relative to said one dipper section so as to change said other dipper section to said closed condition.

3. A power shovel as set forth in claim 1 wherein said dipper handle has a forward end and is pivotable relative to a horizontal position in which said dipper handle extends generally horizontally, wherein said one dipper section includes a back section having a back wall which is mounted on said forward end of said dipper handle, which has a lower end, and which extends generally vertically when said dipper handle is in said horizontal position, a bottom wall which extends forwardly from said lower end of said back wall when said dipper handle is in said horizontal position, and opposed side walls which extend forwardly from said back wall and upwardly from said bottom wall when said dipper handle is in said horizontal position, said side walls having forward edges spaced from said back wall, wherein said other dipper section includes a front section having a front wall which extends generally vertically when said dipper handle is in said horizontal position and which has a lower end, a bottom wall which extends rearwardly from said lower end of said front wall when said dipper handle is in said horizontal position, and opposed side walls which extend rearwardly from said front wall and upwardly from said front section bottom wall when said dipper handle is in said horizontal position, said front section side walls being pivotally connected to said back section side walls for pivotal movement of said front section relative to said back section about a generally horizontal axis located adjacent said forward edges of said back section side walls, said front section being pivotable relative to said back section between open and closed positions respectively corresponding to said open and closed conditions, and wherein said latch mechanism releasably secures said front section in said closed position.

4. A power shovel as set forth in claim 3 wherein said latch mechanism includes a first aperture in one of said side walls of said front section, a second aperture in the other of said side walls of said front section, and first and second latch rods mounted on said back section for movement between extended positions wherein said first and second rods respectively extend into said first and second apertures, and retracted positions wherein said rods are removed from said apertures.

5. A power shovel as set forth in claim 4 wherein said latch mechanism also includes a catch lever mounted on said back section for movement between engaged and disengaged positions, said catch lever being operably connected to said latch rods such that said latch rods move to said retracted positions when said catch lever moves to said disengaged position.

6. A power shovel as set forth in claim 5 wherein said latch rods move to said extended positions when said catch lever moves to said engaged position.

7. A power shovel as set forth in claim 6 wherein said latch rods are biased to said extended positions such that said latch rods automatically extend into said apertures when said front section is in said closed position.

8. A power shovel as set forth in claim 7 wherein said front section engages said latch rods and moves said latch rods to said retracted positions during movement of said front section toward said closed position so as to allow further movement of said front section to said closed position.

9. A power shovel as set forth in claim 8 wherein said catch lever and said latch rods have a lost-motion connection such that said catch lever remains in said engaged position when said front section moves said latch rods to said retracted positions.

10. A power shovel as set forth in claim 4 wherein said side walls of said front section have thereon, adjacent said bottom wall of said front section, respective projections which extend rearwardly when said dipper handle is in said horizontal position and which have therein said apertures.

11. A power shovel as set forth in claim 3 wherein said hoist rope is connected to said front section of said dipper at a point spaced from said axis such that, when said dipper handle is in said dumping position and said front section is in said closed position, said hoist rope extends along a line in front of said axis so that said front section moves to said open position when said latch mechanism is released.

12. A power shovel as set forth in claim 11 wherein said dipper handle is also movable to a closing position, and wherein said hoist rope is connected to said front section such that, when said dipper handle moves to said closing position with said front section in said open position, said hoist rope extends along a line rearward of said axis so that said hoist rope exerts on said front section a force which moves said front section to said closed position.

13. A power shovel as set forth in claim 12 wherein said hoist rope is also connected to said front section so as to substantially prevent swinging of said front section in said open position.

14. A power shovel as set forth in claim 12 wherein said front section side walls include respective extensions extending rearwardly and upwardly relative to said axis when said dipper handle is in said horizontal position, and wherein said rope is connected to said extensions.

15. A power shovel as set forth in claim 3 wherein said back section side walls have respective upper ends, and wherein said axis is located adjacent said upper ends of said back section side walls.

16. A power shovel as set forth in claim 1 wherein said dipper handle has a forward end and is movable relative to a tucked position, wherein said power shovel also comprises crawler tracks supporting said frame for movement over the ground, and wherein said dipper includes a back wall which is mounted on said forward end of said dipper handle, said back wall having a lower end, and said back wall extending generally vertically when said dipper handle is in said horizontal position, a front wall which extends generally vertically when said dipper handle is in said horizontal position and which has a lower end, opposed side walls which extend between said back and front walls, and a bottom wall extending, at least in part, downwardly and rearwardly from said lower end of said front wall when said dipper handle is in said horizontal position, said bottom wall extending upwardly and rearwardly when said dipper handle is in said tucked position, said bottom wall providing clearance for said crawler tracks when said dipper is moved toward said crawler tracks.

17. A power shovel comprising a frame, crawler tracks supporting said frame for movement over the ground, a winch mounted on said frame, a boom having a lower end mounted on said frame and having an upper end, a sheave pivotally mounted on said boom adjacent said upper end of said boom, a dipper handle mounted on said boom for pivotal movement relative thereto, said dipper handle having a forward end, and said dipper handle being movable relative to a horizontal position and relative to a tucked position, a dipper including a back wall which is mounted on said forward end of said dipper handle, said back wall having a lower end, and said back wall extending generally vertically when said dipper handle is in said horizontal position, a front wall which extends generally vertically when said dipper handle is in said horizontal position and which has a lower end, opposed side walls which extend between said back and front walls, and a bottom wall extending, at least in part, downwardly and rearwardly from said lower end of said front wall when said dipper handle is in said horizontal position, said bottom wall extending upwardly and rearwardly when said dipper handle is in said tucked position, said bottom wall providing clearance for said crawler tracks when said dipper is moved toward said crawler tracks, and a hoist rope extending over said sheave, said rope having one end connected to said winch and an opposite end connected to said dipper.

18. A power shovel comprising a frame, a winch mounted on said frame, a boom having a lower end mounted on said frame and having an upper end, a sheave pivotally mounted on said boom adjacent said upper end of said boom, a dipper handle mounted on said boom for pivotal movement relative thereto, said dipper handle being movable between a dumping position and a closing position, a dipper mounted on said dipper handle, said dipper including one section mounted on said dipper handle and an other section movable relative to said one section between closed and open conditions for respectively containing and dumping a load, and a hoist rope extending over said sheave, said rope having one end connected to said winch and an opposite end connected to said other dipper section such that, when said dipper handle is in said dumping position, said hoist rope exerts on said other dipper section a force moving said other dipper section relative to said one dipper section so as to change said other dipper section to said open condition, and such that, when said dipper handle moves to said closing position with said other dipper section in said open condition, said hoist rope exerts on said dipper a force moving said other dipper section relative to said one dipper section so as to change said other dipper section to said closed condition.

19. A power shovel as set forth in claim 18 wherein said dipper further includes a latch mechanism for releasably securing said other dipper section in said closed condition, and wherein said other dipper section changes to said open condition when said latch mechanism is released.

20. A power shovel as set forth in claim 18 wherein said dipper handle has a forward end and is pivotable relative to a horizontal position in which said dipper handle extends generally horizontally, wherein said one dipper section includes a back section having a back wall which is mounted on said forward end of said dipper handle, which has a lower end, and which extends generally vertically when said dipper handle is in said horizontal position, a bottom wall which extends forwardly from said lower end of said back wall when said dipper handle is in said horizontal position, and opposed side walls which extend forwardly from said back wall and upwardly from said bottom wall when said dipper handle is in said horizontal position, said side walls having forward edges spaced from said back wall, and wherein said other dipper section includes a front section having a front wall which extends generally vertically when said dipper handle is in said horizontal position and which has a lower end, a bottom wall which extends rearwardly from said lower end of said front wall when said dipper handle is in said horizontal position, and opposed side walls which extend rearwardly from said front wall and upwardly from said front section bottom wall when said dipper handle is in said horizontal position, said front section side walls being pivotally connected to said back section side walls for pivotal movement of said front section relative to said back section about a generally horizontal axis located adjacent said forward edges of said back section side walls, said front section being pivotable relative to said back section between open and closed positions respectively corresponding to said open and closed conditions.

21. A power shovel as set forth in claim 20 wherein said hoist rope is connected to said front section of said dipper at a point spaced from said axis such that, when said dipper handle is in said dumping position and said front section is in said closed position, said hoist rope extends along a line in front of said axis so that said front section moves to said open position when said latch mechanism is released.

22. A power shovel as set forth in claim 21 wherein said dipper handle is also movable to a closing position, and wherein said hoist rope is connected to said front section such that, when said dipper handle moves to said closing position with said front section in said open position, said hoist rope extends along a line rearward of said axis so that said hoist rope exerts on said front section a force which moves said front section to said closed position.

23. A power shovel comprising a frame, a winch mounted on said frame, a boom having a lower end mounted on said frame and having an upper end, a sheave pivotally mounted on said boom adjacent said upper end of said boom, a dipper handle which has a forward end and which is mounted on said boom for pivotal movement relative thereto, a dipper including a first section which is mounted on said forward end of said dipper handle and which has opposite first and second sides, a second section which has opposite first and second sides and which is connected to said first section for pivotal movement relative thereto between open and closed positions, and a latch mechanism for releasably securing said first side of said second section to said first side of said first section and for releasably securing said second side of said second section to said second side of said first section so as to releasably secure said second section in said closed position, said latch mechanism including a first member which is supported by one of said Sections and which engages the first side of the other of said sections, and a second member which is supported by one of said sections and which engages the second side of the other of said sections, and a hoist rope extending over said sheave, said rope having one end connected to said winch and an opposite end connected to said dipper.

24. A power shovel as set forth in claim 23 wherein said first section has opposite first and second side walls respectively located on said first and second sides of said first section, wherein said second section has opposite first and second side walls respectively located on said first and second sides of said second section, wherein said latch mechanism includes first and second apertures respectively located in said first and second side walls of said second section, and wherein said first and second members respectively include first and second latch rods mounted on said first section for movement between extended positions wherein said first and second rods respectively extend into said first and second apertures, and retracted positions wherein said rods are removed from said apertures.

25. A power shovel as set forth in claim 24 wherein said latch mechanism also includes a catch lever mounted on said first section for movement between engaged and disengaged positions, said catch lever being operably connected to said latch rods such that said latch rods move to said retracted positions when said catch lever moves to said disengaged position.

26. A power shovel as set forth in claim 25 wherein said latch rods move to said extended positions when said catch lever moves to said engaged position.

27. A power shovel as set forth in claim 26 wherein said latch rods are biased to said extended positions such that said latch rods automatically extend into said apertures when said second section is in said closed position.

28. A power shovel as set forth in claim 27 wherein said second section engages said latch rods and moves said latch to said retracted positions during movement of said second section toward said closed position so as to allow further movement of said second section to said closed position.

29. A power shovel as set forth in claim 28 wherein said catch lever and said latch rods have a lost-motion connection such that said catch lever remains in said engaged position when said second section moves said latch rods to said retracted positions.

30. A power shovel as set forth in claim 24 wherein said dipper handle is movable relative to a horizontal position, and wherein said side walls of said second section have thereon respective projections which extend rearwardly when said dipper handle is in said horizontal position and which have therein said apertures.

31. A power shovel comprising a frame, a winch mounted on said frame, a boom having a lower end mounted on said frame and having an upper end, a sheave pivotally mounted on said boom adjacent said upper end of said boom, a dipper handle mounted on said boom for pivotal movement relative thereto, said dipper handle being movable relative to a dumping position, and said dipper handle having a longitudinal axis defining a generally vertical plane, a dipper mounted on said dipper handle, said dipper including one section mounted on said dipper handle and an other section movable relative to said one section between closed and open conditions for respectively containing and dumping a load, and a hoist rope extending over said sheave, said rope having one end connected to said winch and an opposite end connected to said other dipper section along a single line generally perpendicular to said plane, such that said power shovel has no hoist ropes connected to said dipper along lines other than said single line, said rope being connected to said dipper such that, when said dipper handle is in said dumping position, said hoist rope exerts on said other dipper section a force moving said other dipper section relative to said one dipper section so as to change said other dipper section to said open condition, said dipper being supported only by said dipper handle and said hoist rope.

32. A power shovel comprising a frame, a winch mounted on said frame, a boom having a lower end mounted on said frame and having an upper end, a sheave pivotally mounted on said boom adjacent said upper end of said boom, a dipper handle mounted on said boom for pivotal movement relative thereto, said dipper handle having a forward end and being pivotable relative to a horizontal position in which said dipper handle extends generally horizontally, a dipper mounted on said forward end of said dipper handle, said dipper having closed and open conditions for respectively containing and dumping a load, said dipper including a back section having a back wall which is mounted on said forward end of said dipper handle, said back wall having a lower end, and said back wall extending generally vertically when said dipper handle is in said horizontal position, a bottom wall which extends forwardly from said lower end of said back wall when said dipper handle is in said horizontal position, and opposed side walls which extend forwardly from said back wall and upwardly from said bottom wall when said dipper handle is in said horizontal position, said side walls having forward edges spaced from said back wall, said dipper also including a front section having a front wall which extends generally vertically when said dipper handle is in said horizontal position and which has a lower end, a bottom wall which extends rearwardly from said lower end of said front wall when said dipper handle is in said horizontal position, and opposed side walls which extend rearwardly from said front wall and upwardly from said front section bottom wall when said dipper handle is in said horizontal position, said front section side walls being pivotally connected to said back section side walls for pivotal movement of said front section relative to said back section about a generally horizontal axis located adjacent said forward edges of said back section side walls, said front section being pivotable relative to said back section between open and closed positions respectively corresponding to said open and closed conditions, and said dipper further including a latch mechanism for releasably securing said front section in said closed position, and a hoist rope extending over said sheave, said rope having one end connected to said winch and an opposite end connected to said dipper.

33. A power shovel as set forth in claim 23 wherein said first and second members are both supported by the same one of said sections.

* * * * *